US006718709B2

(12) United States Patent
Koutras et al.

(10) Patent No.: US 6,718,709 B2
(45) Date of Patent: Apr. 13, 2004

(54) SNAP PANEL DISPLAY UNIT

(76) Inventors: Tim Koutras, P.O. Box 4142, Redondo Beach, CA (US) 90277; Saro Sarkisyan, 715 E. Palmer, Glendale, CA (US) 91205; Veram Badangiz, 18647 Eccles St., St. Northridge, CA (US) 91324; Paul Edmunds, 302 S. Catalina, Redondo Beach, CA (US) 90277

( * ) Notice: Subject to any disclaimer, the term of this patent is extended or adjusted under 35 U.S.C. 154(b) by 28 days.

(21) Appl. No.: 10/119,761

(22) Filed: Apr. 11, 2002

(65) Prior Publication Data

US 2003/0192271 A1 Oct. 16, 2003

(51) Int. Cl.[7] ..... E04B 1/38

(52) U.S. Cl. ..... 52/285.1; 52/239; 52/580.21; 52/582.1; 52/585.1; 52/586; 52/588; 52/591.4; 52/591.5; 52/591; 52/592; 52/593; 403/217; 403/169; 403/170; 403/294; 46/21; 46/25; 46/26; 46/30; 46/31; 40/152.1; 40/152; 40/605; 40/611; 40/642; 40/661; 446/108.111; 446/112; 446/114; 446/124; 446/127; 446/120; 160/395; 160/135; 160/229.1

(58) Field of Search ..... 52/285.1, 582.1, 52/586, 585.1, 631, 593, 592, 591, 588, 608, 609, 580.21, 591.4, 591.5, 239; 46/30, 31, 21, 25, 26; 40/152, 152.1, 605, 611, 642, 661; 446/108.111, 112, 114, 124, 127, 120; 160/395, 135, 229.1; 403/217, 294, 169, 170

(56) References Cited

U.S. PATENT DOCUMENTS 1,557,165 A * 10/1925 Hooper ..... 404/40
2,708,329 A * 5/1955 McKee ..... 52/286
3,657,838 A * 4/1972 Hanning et al. ..... 446/126
3,827,177 A * 8/1974 Wengel ..... 446/112
3,859,769 A * 1/1975 Watkins ..... 52/591.1
3,866,379 A * 2/1975 Paulke ..... 52/311.2
3,955,329 A * 5/1976 Hannula ..... 52/81.4
4,001,987 A * 1/1977 Coulthard ..... 52/79.9
4,043,086 A * 8/1977 Kaulfuss et al. ..... 52/71
4,118,903 A * 10/1978 Coulthard ..... 160/351
4,128,286 A * 12/1978 Windisch et al. ..... 312/234
4,195,437 A * 4/1980 Ace ..... 446/104
4,257,207 A * 3/1981 Davis ..... 52/578
4,275,520 A * 6/1981 Appleton et al. ..... 40/605
4,365,454 A * 12/1982 Davis ..... 52/578
4,375,829 A * 3/1983 Dorr et al. ..... 160/135
4,467,854 A * 8/1984 Godfrey ..... 160/135
4,493,174 A * 1/1985 Arens ..... 52/243
4,531,564 A * 7/1985 Hanna ..... 160/351
4,573,513 A * 3/1986 Small et al. ..... 160/135
4,635,418 A 1/1987 Hobgood
4,785,565 A * 11/1988 Kuffner ..... 40/605
4,912,866 A * 4/1990 Bannister et al. ..... 40/605
4,926,609 A * 5/1990 Arico ..... 52/582.2
4,928,465 A * 5/1990 Del Castillo Von Haucke ..... 52/239
4,932,538 A * 6/1990 Gambello ..... 211/87.01

(List continued on next page.)

*Primary Examiner*—Carl D. Friedman
*Assistant Examiner*—Christy Green
(74) *Attorney, Agent, or Firm*—Richard C. Litman

(57) ABSTRACT

A light-weight, portable display system which includes plural, hollow, plastic panels having uniquely contoured corners. The panels may be of flat or curved configuration. Most of the plastic panels are fabricated to present smooth front and rear faces. However, some panels are made with at least one slotted face for supporting shelves therein. Straight plastic connector components are designed to accept the corners of the panels, thereby connecting the panels in a manner to form a display area. Hinged plastic connectors are provided so that adjacent panels may be arranged at angles ranging from ninety to one hundred eighty degrees.

12 Claims, 4 Drawing Sheets

U.S. PATENT DOCUMENTS 4,995,144 A * 2/1991 Gateley ..... 16/261
5,007,473 A * 4/1991 Evensen ..... 160/135
5,054,507 A * 10/1991 Sparks ..... 135/97
5,121,526 A * 6/1992 Burkard et al. ..... 24/336
5,249,383 A * 10/1993 McCusker et al. ..... 40/654.01
5,291,700 A * 3/1994 Chew ..... 52/36.1
5,412,918 A * 5/1995 Wendel et al. ..... 52/582.1
5,520,447 A * 5/1996 Burgdorf et al. ..... 303/119.3
5,603,370 A * 2/1997 Boer ..... 160/135
5,640,816 A * 6/1997 Reiland et al. ..... 52/239
5,647,181 A * 7/1997 Hunts ..... 52/282.1
5,732,757 A * 3/1998 Mariol ..... 160/135
5,803,146 A * 9/1998 Boon ..... 160/135
5,871,384 A * 2/1999 Kichijo ..... 446/112
5,878,802 A 3/1999 Richter et al.
6,089,941 A * 7/2000 Glickman et al. ..... 446/111
6,293,328 B1 * 9/2001 Fremont ..... 160/135
6,340,046 B1 * 1/2002 Basseches ..... 160/135
6,393,782 B1 * 5/2002 Berridge et al. ..... 52/239
D458,041 S * 6/2002 Couture et al. ..... D6/332
6,443,798 B1 * 9/2002 Perry ..... 446/127
6,493,917 B1 * 12/2002 Sunka ..... 29/413
6,520,831 B1 * 2/2003 Craig ..... 446/476

* cited by examiner

SNAP PANEL DISPLAY UNIT

BACKGROUND OF THE INVENTION

1. Field of the Invention

The present invention generally relates to display systems More specifically, the present invention is drawn to portable, light-weight, display panels which may be easily assembled and disassembled without the use of tools.

2. Description of the Related Art

The portable, knock-down panel systems used for display purposes at trade shows, educational presentations, temporary art exhibits and the like, are for the most part cumbersome to assemble and disassemble. Many are heavy and require more than one person to manipulate. Many require special tools for both assembly and disassembly. Others comprise many parts, which parts must be collected and safely stored. For example, U.S. Pat. No. 4,001,987 (Coulthard) is drawn to a screen construction applicable to exhibition and display purposes which employs clips that are secured to panels by wood screws. Further, the construction requires the use of upright metal poles for support.

U.S. Pat. No. 4,118,903 (Coulthard) discloses an assembly for forming a partition or screen especially for display purposes. The panels which constitute the partition are connected at their upper edges with hook and loop fasteners. There is no provision for arranging the panels in a stacked array.

U.S. Pat. No. 4,128,286 (Windisch et al.) shows a portable display wall having abutting complimentary panels. Vertical legs and wing nuts must be utilized to support and secure the panels.

Hook and loop fasteners are employed to connect and secure panels in U.S. Pat. No. 4,635,418 (Hobgood). The use of such fasteners is not considered to provide suitable support when the panels are arranged in a stacked array.

U.S. Pat. No. 5,732,757 (Mariol) and U.S. Pat. No. 5,878,802 (Richter et al.) disclose display systems which require a plurality of tubes for support.

U.S. Pat. No. 4,785,565 (Kuffner) employs relatively heavy and costly metal components as connecting members for the panels.

U.S. Pat. No. 4,257,207 (Davis) discloses the use of plastic connectors for panel assembly. It is noted however, that the connectors must be inserted in slots formed at a central area of the panels instead of at the corners.

None of the above inventions and patents, taken either singularly or in combination, is seen to disclose a display unit as will subsequently be described and claimed in the instant invention.

SUMMARY OF THE INVENTION

The present invention is drawn to a light-weight, portable display system. The system comprises plural, hollow, plastic panels having uniquely contoured corners. The panels may be of flat or curved configuration. Most of the plastic panels are fabricated to present smooth front and rear faces. However, some panels are made with at least one slotted face for supporting shelves therein. Straight plastic connector members are designed to accept the corners of the panels, thereby connecting the panels in a manner to form a display area. Hinged plastic connectors are provided so that adjacent panels may be arranged at angles ranging from ninety to one hundred eighty degrees.

As contemplated, the panels can be connected in a vertical array to create a stable display wall as high as ten feet. The panels are reversible since either face of the panel can be utilized as a display area. By employing a combination of planar and curved panels and straight and hinged connectors, a user may construct a display area of configurations limited only by the user's imagination. The panels and connectors may be fabricated in various colors so as to satisfy different aesthetic tastes.

Since no tools are required and the components are fabricated from light-weight plastic, it is evident that the panels of the instant invention can be quickly and easily assembled and disassembled by a single person. Further, the all-plastic fabrication dramatically lowers construction and shipping costs.

Accordingly, it is a principal object of the invention to provide an improved display system, which system is completely fabricated from plastic parts.

It is another object of the invention to provide an improved display system, which system can be easily assembled and disassembled by one person.

It is a further object of the invention to provide an improved display system, which system can be assembled and disassembled without the use of tools.

Still another object of the invention is to provide an improved display system, which system utilizes a unique connector member for snap-fitting the system in an assembled array.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
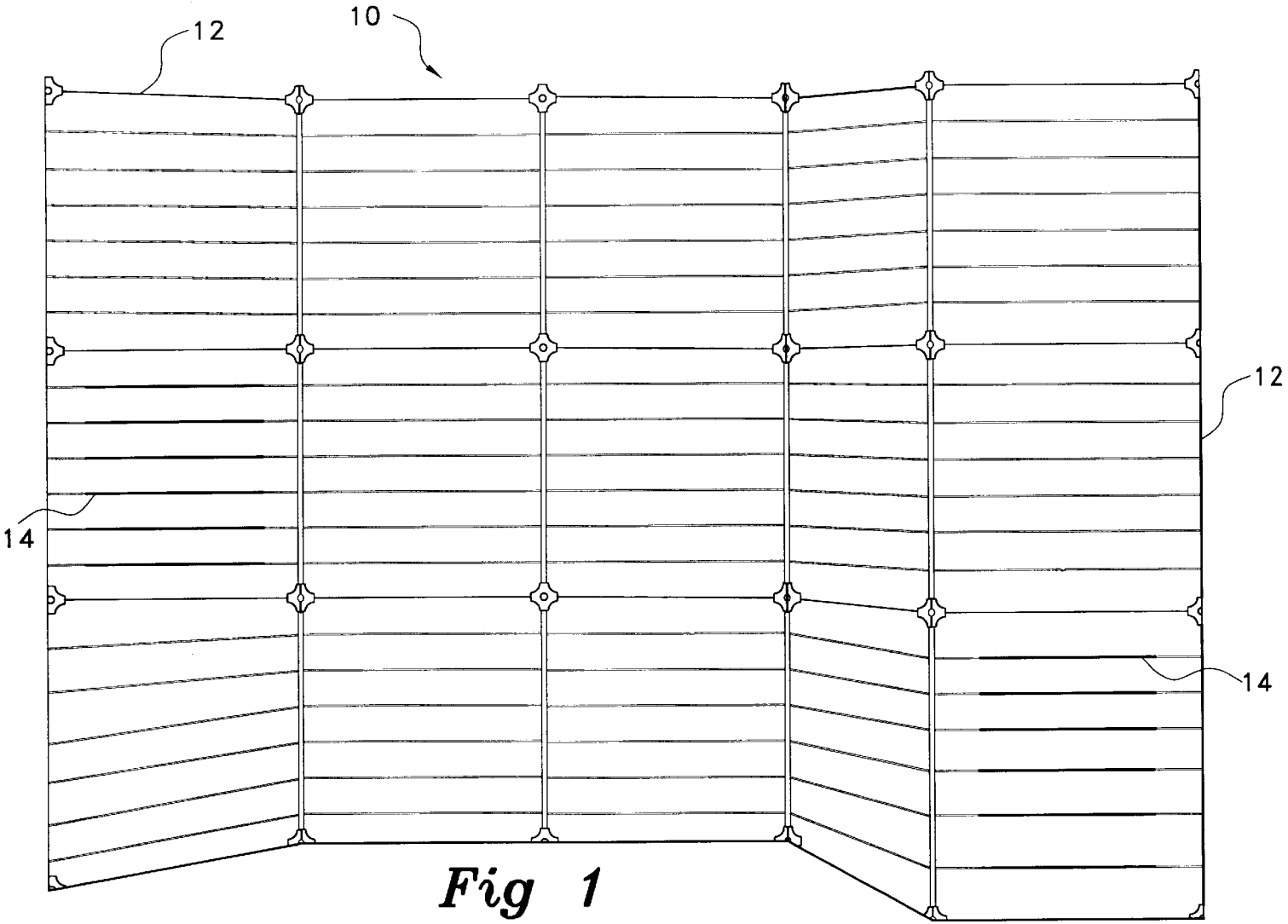
FIG. 1 is an environmental, perspective view of a snap panel display unit according to the present invention.
Figures 2A, 2B, 2C:
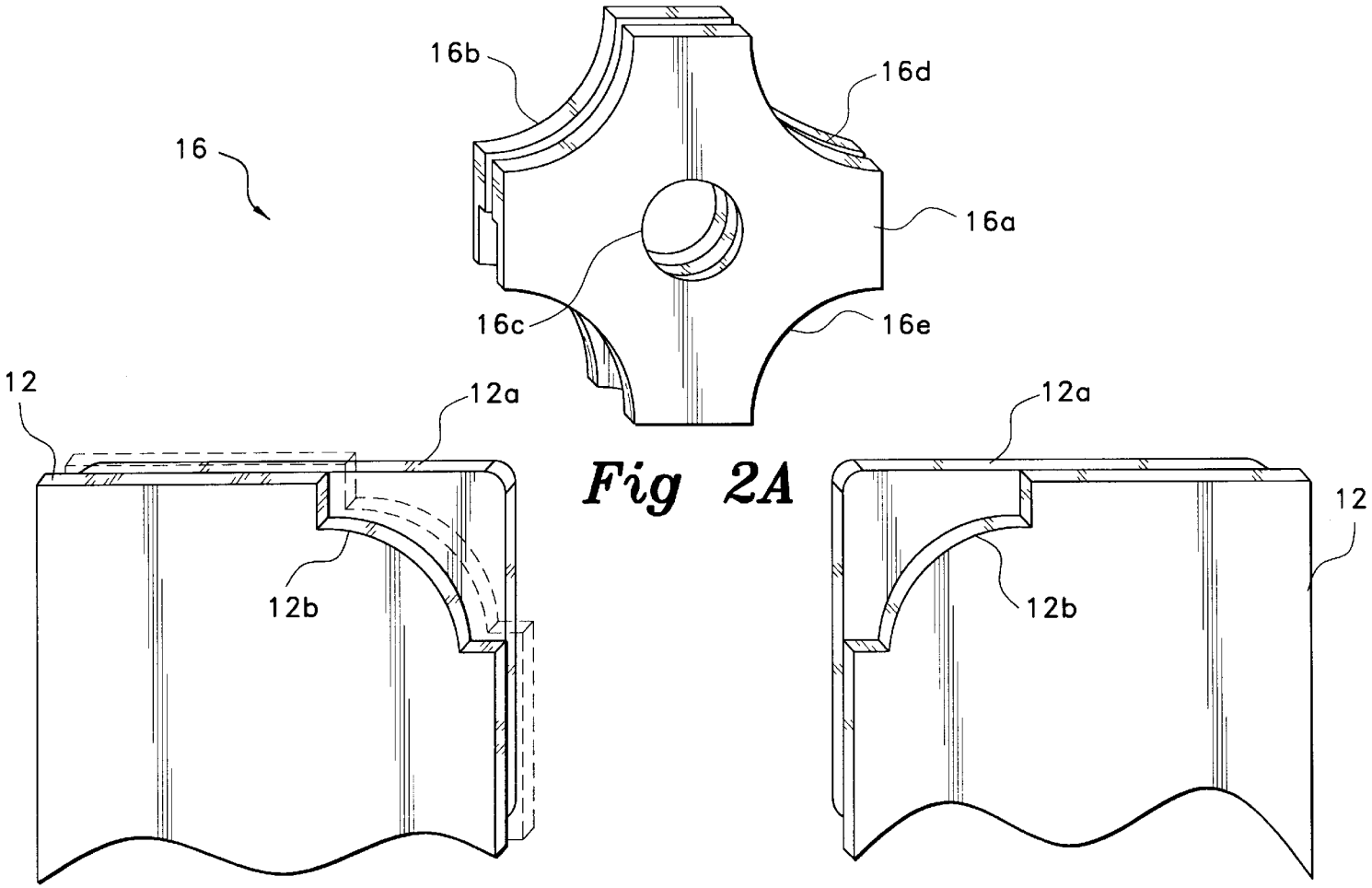
FIGS. 2A–2C are views showing details of the panels and straight connector arrangement according to the present invention.
Figure 3:
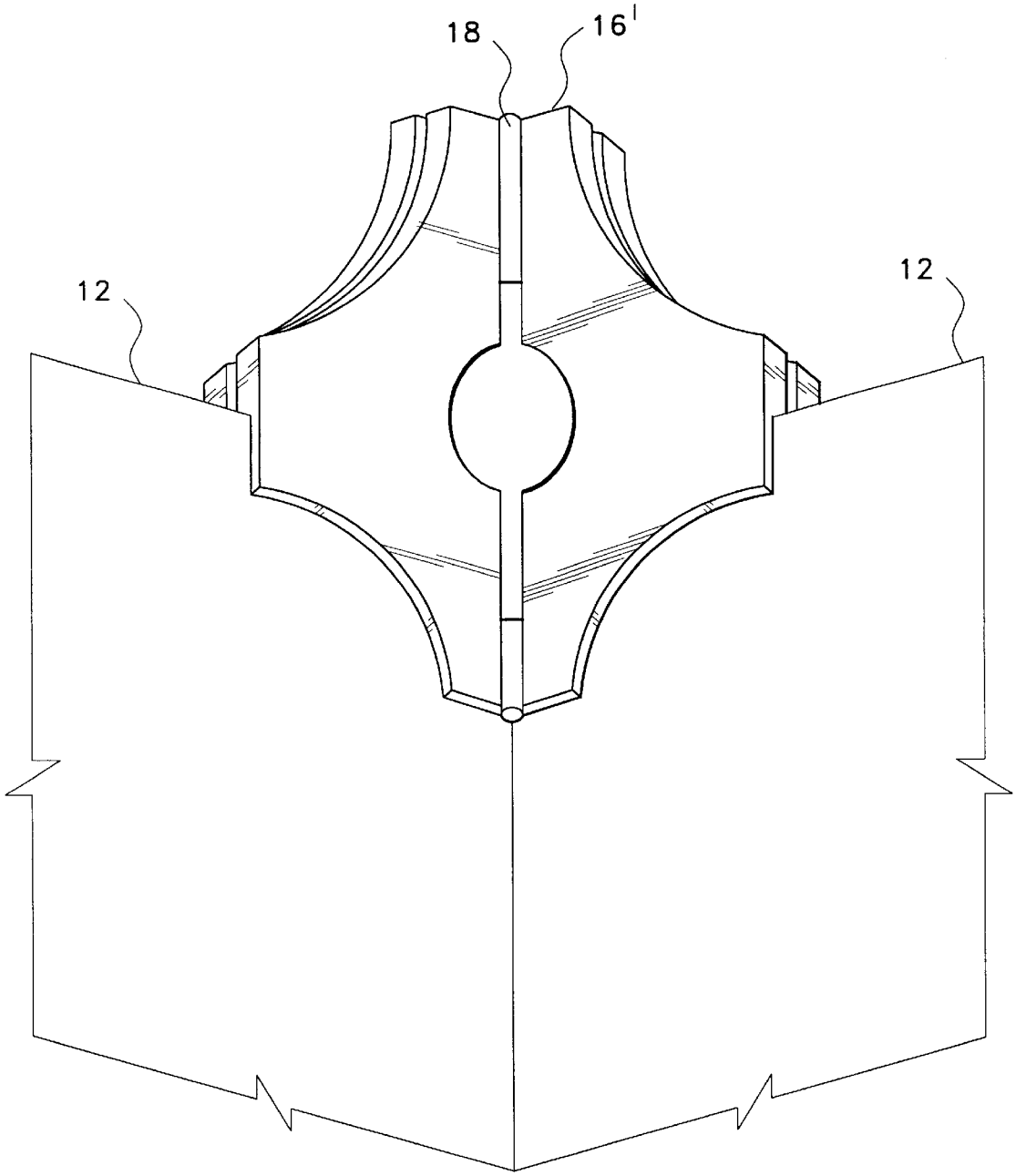
FIG. 3 is a partial view of panels and a corner connector according to the present invention.

Attention is directed to FIG. 1 wherein the snap panel display unit of the instant invention is generally indicated at 10. Display unit 10 comprises an array of individual panels 12, which panels are aligned and stacked to form a display area. Panels 12 are flat, hollow and fabricated from plastic material. As presently contemplated, each panel 12 is a two-foot square although other sizes may function equally as well. The front and rear flat faces of the panels are generally smooth so that material to be displayed may be easily attached thereto. However, some of the panels are provided with at least one slotted face 14. The slots allow shelves or trays to be inserted therein, thereby adding versatility to the type of material that can be displayed on the unit.

As best illustrated in FIGS. 2A–2C and 3, a pair of panels 12 is assembled by employing at least one straight locking member 16 or corner locking member 16'. Straight locking member 16 is of a cruciform configuration having mirror image front and rear sections 16*a*, 16*b*. An open tubular member 16*c* functions to attach section 16*a* to section 16*b* such that a narrow opening 16*d* is formed between the sections. The edges 16*e* of member 16 are partially curved for purposes as will be explained below. Each corner of a panel 12 is contoured to form a thin, flat insert portion 12*a* and a curved profile portion 12*b*. Insert portion 12*a* is dimensioned to be slightly thicker than the width of opening 16*d*. Curved profile portion 12*b* is designed to be complimentary with the curve of edge 16*e*. This arrangement allows each corner insert portion 12*a* of adjacent panels to be snap-fitted into opening 16*d* of a connector member, thereby assembling the panels to form a display unit. Since the curved edges of the connectors are complimentary with the curved portions of the panel, an aesthetically pleasing display unit will be presented. Besides functioning as an attachment member, open tubular member 16*c* will also allow easy installation of lighting fixtures on the unit. Corner connector 16' is fabricated exactly as is straight connector 16 with the exception that a hinge 18 is disposed along the central axis thereof. Hinge 18 will allow the panels utilizing the corner connector to be assembled at angles ranging from ninety to one hundred degrees.

Figure 4:
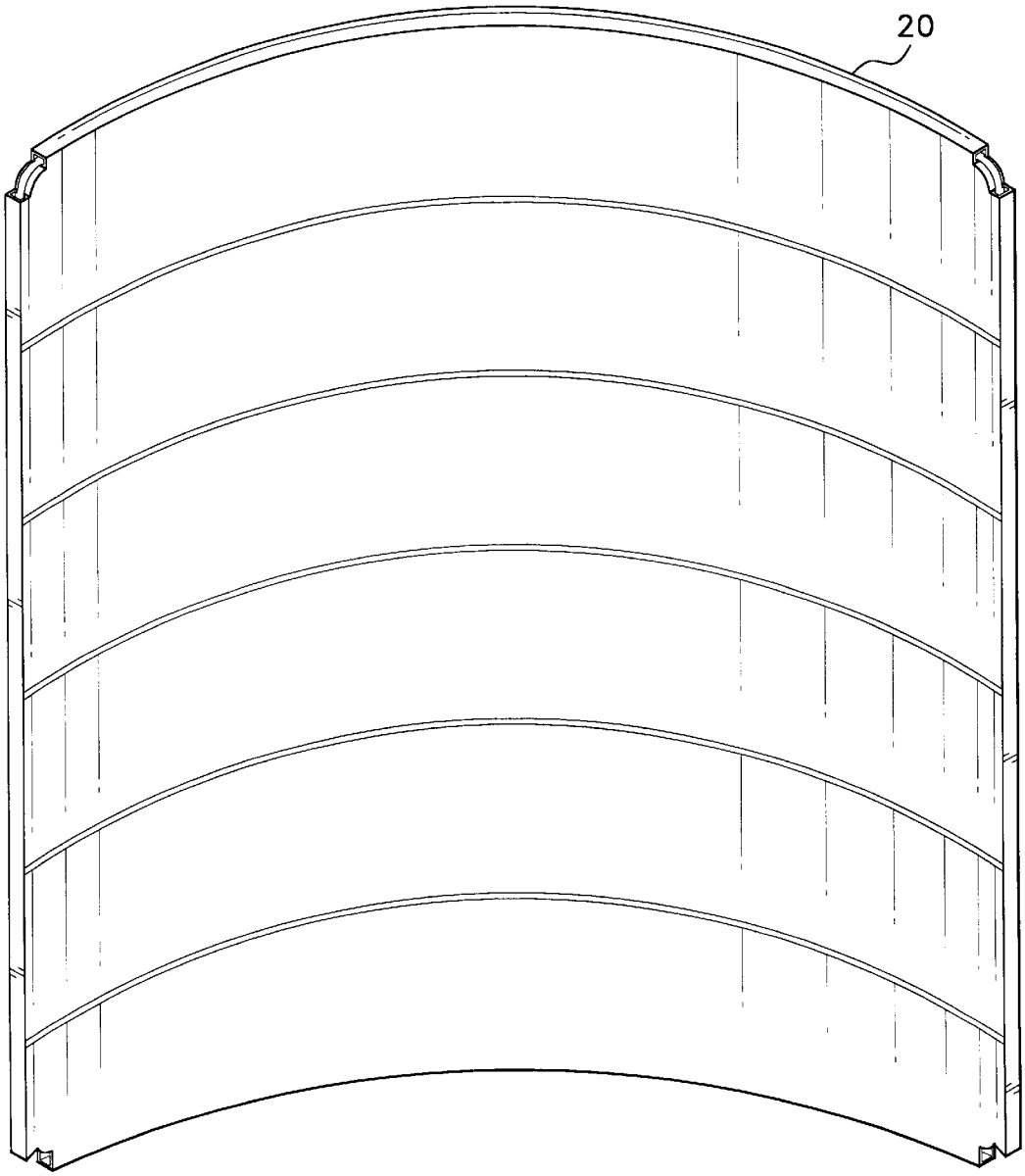
FIG. 4 is a perspective view of a curved panel according to the present invention.

FIG. 4 is illustrative of a panel 20 having a curved configuration. Curved panel 20 will utilize the same straight connectors 16 as discussed above. The employment of curved panels will add even more versatility in that a user may employ a combination of flat and curved panels to create unusual display units.

It is to be understood that the present invention is not limited to the embodiments described above, but encompasses any and all embodiments within the scope of the following claims.

We claim:

1. A display unit comprising:

a plurality of hollow, plastic panel sections, each of said panel sections having a front face and a rear face;

plural corners formed on each of said panel sections;

plastic connector components attached at said plural corners for interconnecting said panel sections, wherein each of said plural corners includes a flat insert portion having a thickness and a curved profile portion.

2. A display unit as recited in claim 1, wherein each of said plastic connector components includes a first section;

a second section, said second section being a mirror image of said first section and axially spaced from said first section so as to form a narrow opening therebetween;

an open tubular member, said tubular member connecting said first section to said second section; and curved edges formed on said first section and said second section.

3. A display unit as recited in claim 2, wherein the thickness of said flat insert portion is slightly larger than the width of said narrow opening.

4. A display unit as recited in claim 3, wherein said curved profile portion of said plural corners and said curved edges formed on said first section and said second section are complimentary.

5. A display unit as recited in claim 4, including an axial hinge formed in at least one of said plastic connector components.

6. A display unit as recited in claim 5, wherein said front face and said rear face of each said panel section are smooth.

7. A display unit as recited in claim 5, wherein a portion of said plurality of hollow, plastic panel sections is flat and wherein a portion of said plurality of hollow, plastic panel sections is curved.

8. A display unit as recited in claim 5, wherein at least one of said front face and said rear face is slotted.

9. A display unit as recited in claim 8, wherein a portion of said plurality of hollow, plastic panel sections is flat and wherein a portion of said plurality of hollow, plastic panel sections is curved.

10. A display unit comprising:

a plurality of hollow, plastic panel sections, each panel section having a front face, a rear face;

plural corners formed on each of said panel sections, wherein each of said plural corners includes a flat insert portion having a thickness and a curved profile portion;

plastic connector components attached at said plural corners for interconnecting said panel sections, wherein each of said plastic connector components includes a first section configured as a cruciform;

a second section configured as a cruciform, said second section being a mirror image of said first section and axially spaced from said first section so as to form a narrow opening therebetween;

an open tubular member, said tubular member connecting said first section to said second section; and curved edges formed on said first section and said second section.

11. A display unit as recited in claim 10, wherein the thickness of said flat insert portion is slightly larger than the width of said narrow opening.

12. A display unit as recited in claim 11, wherein said curved profile portion of said plural corners and said curved edges formed on said first section and said second section are complimentary.

* * * * *